United States Patent [19]

Chiaradonna

[11] 4,086,674

[45] May 2, 1978

[54] WIND SHIELDING DOME

[76] Inventor: Carmine M. Chiaradonna, 39 Spring Rd., Lynn, Mass. 01912

[21] Appl. No.: 749,525

[22] Filed: Dec. 10, 1976

[51] Int. Cl.[2] ..... A47C 29/00; E04B 7/10

[52] U.S. Cl. ..... 5/113; 5/121; 52/66; 135/1 R

[58] Field of Search ..... 5/82, 113, 111, 362, 5/284; 297/184, 353, 355, 19, 22, 29; 312/284; 135/5 R; 52/66; 14/71

[56] References Cited

U.S. PATENT DOCUMENTS

| | | | |
|---|---|---|---|
| 2,911,245 | 11/1959 | Kurz | 5/111 X |
| 3,344,442 | 10/1967 | Andrews | 312/284 |
| 3,560,043 | 2/1971 | Harter | 52/66 |
| 3,797,178 | 3/1974 | Mule | 52/66 |
| 3,848,279 | 11/1974 | Ipsen, Jr. | 5/113 |

FOREIGN PATENT DOCUMENTS

| | | | |
|---|---|---|---|
| 986,002 | 7/1951 | France | 52/66 |

*Primary Examiner*—Casmir A. Nunberg
*Attorney, Agent, or Firm*—Clarence A. O'Brien; Harvey B. Jacobson

[57] ABSTRACT

A transparent dome mountable on a multi-position lounge for shielding a person on the lounge from rain, wind, and cold has a main dome section to which are pivotally attached a head dome section and a foot dome section. Pivotal connections of the generally U-shaped dome sections to one another permits the dome to conform to a particular position of a multi-position lounge on which the dome is mounted by clips affixed to the main dome section and engageable with a rail of the frame of the lounge.

4 Claims, 4 Drawing Figures

WIND SHIELDING DOME

BACKGROUND OF THE INVENTION

1. Field of the Invention

This invention relates generally to wind shielding devices, and particularly to a wind shielding dome mountable on a multi-position lounge for adjustment with the lounge.

2. Description of the Prior Art

U.S. Pat. No. 2,166,832, issued July 18, 1939, to H. Wenker, discloses a sunshade attachment for use with deck chairs, and the like, which employs a substantially U-shaped member of rigid construction and disposable on a deck chair so as to extend from the top of the back of the chair to the foot rest thereof. Further, U.S. Pat. No. 3,431,923, issued Mar. 11, 1969, to R. J. Klepac, discloses a beach cabana which can be anchored on a beach of other earth surface to protect a sun bather, while U.S. Pat. No. 3,670,750, issued June 20, 1972, to E. W. Johnston, discloses a cot having end and side panels arranged for providing a sun bather with privacy. None of these prior art sun and wind shielding devices, however, was intended for use with the multi-position lounges commonly used today. In addition, U.S. Pat. No. 2,166,832, which shows an attachment mounted over a deck chair, is specifically intended to protect a person reclining on the chair from the rays of the sun.

SUMMARY OF THE INVENTION

It is an object of the present invention to provide a wind shielding dome which permits use of the rays from the sun for tanning of the body of a person beneath the dome, and also the use of the heat from the sun rays for providing relief to aches and pains in the body of the person under the dome, while protecting the person from cold and wind while the sun rays pass through the dome.

It is another object of the present invention to provide a wind shielding dome particularly for use with multi-position lounges.

It is a still further object of the present invention to provide a wind shielding dome which may be easily disassembled for compact storage when not in use.

These and other objects are achieved according to the present invention by providing a wind shielding dome for a multi-position lounge which has: a main dome section; a head dome section and a foot dome section each pivotally connected to the main dome section in spaced relation to one another for conforming to a lounge on which the dome is disposed; and a fastener arrangement permitting removable attachment of the dome to the lounge.

Preferably, each of the main dome section, head dome section, and foot dome section is a curved element substantially in the shape of an inverted U and constructed from a transparent material which permits the rays from the sun to pass through the dome. The curvature of the dome sections is traverse of the extent of the main dome section, head dome section and foot dome section from the head to the foot of the associated lounge. The head dome section and foot dome section are advantageously pivotally connected to the main dome section as by suitable hinges mounted to the main dome section adjacent the end edge thereof and substantially midway between lateral edges of the main dome section. The hinges are attached to the head dome section and foot dome section in similar locations such that the adjacent edges of the sections will be aligned with one another when the sections are in abutting relationship.

The fastener arrangement includes at least one spring-biased clip attached to the main dome section and provided with jaw portions having arcuate recesses which engage a rail of the frame of the lounge on which the dome is disposed. Spring latches retain the main dome section, as well as the head dome section and foot dome section, adjacent the frame of the lounge whenever such retention is desirable.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
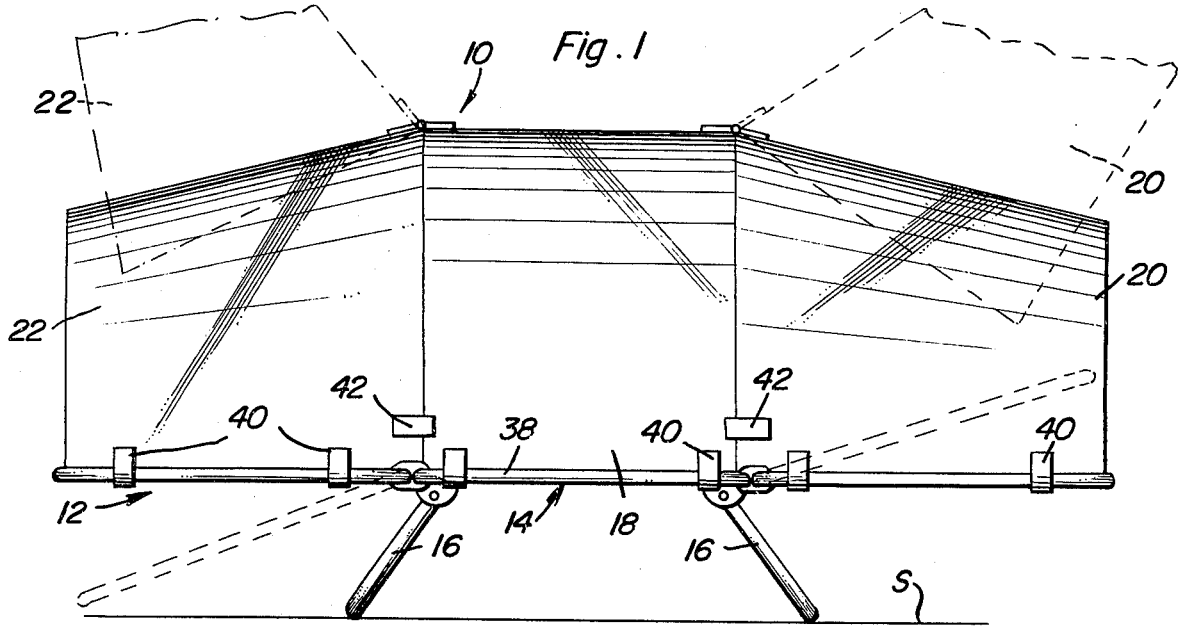
FIG. 1 is a side elevational view showing a wind shielding dome according to the present invention disposed on a multi-position lounge.
Figure 2:
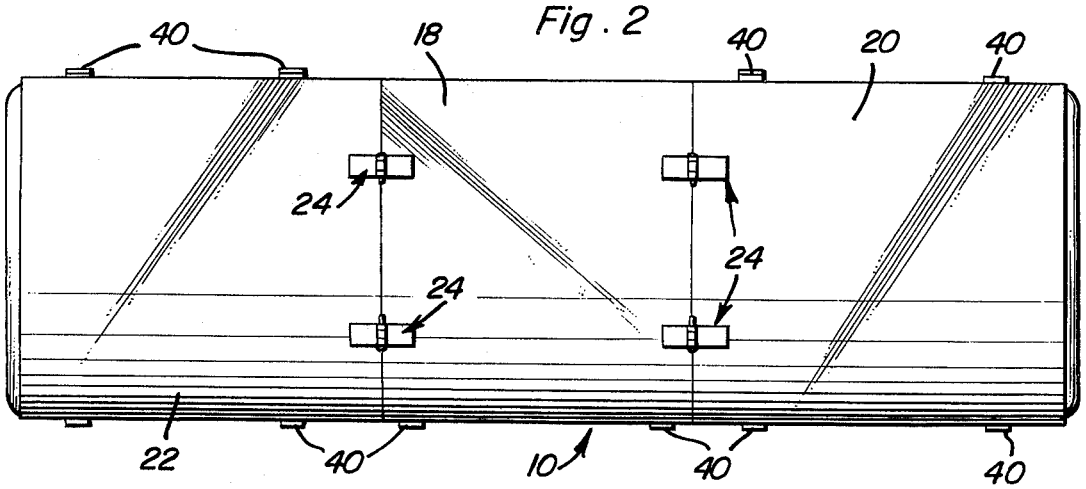
FIG. 2 is a top plan view of the arrangement shown in FIG. 1.
Figure 3:
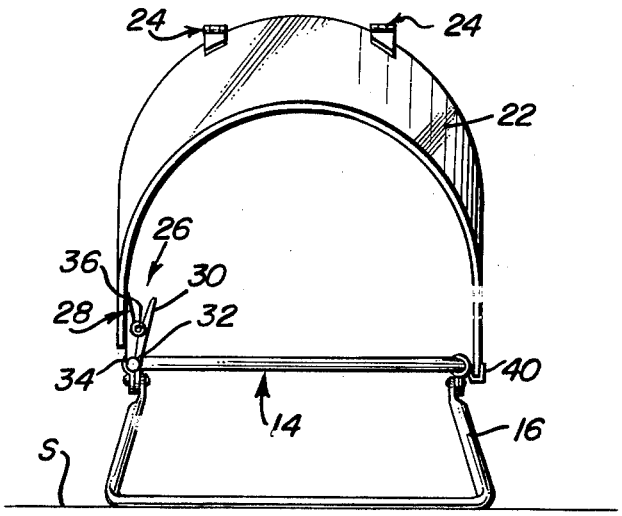
FIG. 3 is an end elevational view of the arrangement shown in FIGS. 1 and 2.

Referring now more particularly to FIGS. 1 through 3 of the drawings, a wind shielding dome 10 according to the present invention is shown as mounted on a multi-position lounge 12 of conventional construction. Lounge 12 includes a generally rectangular frame 14 comprising three sections articulated together, with the central section supported on a surface S as by pivotally mounted U-shaped legs 16. Dome 12 is formed by a main dome section 18 to which is pivotally connected a head dome section 20 and a foot dome section 22. The pivotal connection of sections 20 and 22 to section 18 in spaced relation to one another permits dome 10 to conform to a particular position of lounge 12. Each of the sections 18, 20 and 22 is a curved element substantially in the form of an inverted U-shape and constructed from a suitable transparent material, such as polymethyl methacrylate, with the curvature thus formed being traverse to the extent of the sections 18, 20 and 22 from head to foot of dome 10 and the associated lounge 12. The pivotal connection of sections 20 and 22 to section 18 which permits the dome 10 to conform to most positions of lounge 12 is realized by the use of conventional leaf and pin hinges 24 mounted to section 18 adjacent an end edge thereof substantially midway between lateral edges of the section 18, or at the transitional portion of the U-shape of the section, with the sections 20 and 22 likewise being affixed to the associated leaves of hinges 24 in a similar area so that the sections 20 and 22 will be in alignment with the adjacent edges of section 18 when the sections 20 and 22 are in a position as shown in full lines in FIGS. 1 and 2 wherein the three sections 18, 20 and 22 of dome 10 are in abutting relationship.

Dome 10 is provided with a fastener arrangement for removably attaching dome 10 to lounge 12. More specifically, this fastener arrangement includes at least one, and preferably the illustrated pair, of spring-biased clips 26 attached to main dome section 18 and releasably engaging with frame 14 of lounge 12. Each of these clips 26 includes a pair of levers 28, each having a handle portion 30 and a jaw portion 32. An arcuate recess 34 is provided in each jaw portion 32, with one of the levers 28 having the handle portion 30 thereof affixed to the inner surface of dome section 18 adjacent a lateral edge of section 18. A conventional torsion spring 36 is connected to levers 28 at fulcrum points thereof for biasing the jaw portions 32 of each of the levers 28 toward the jaw portion 32 of the other of the levers 28. The recesses 34 of each of the jaw portions 32 are disposed opposite the recess 34 of the other jaw portion 32, the recesses 34 gripping a rail 38 of frame 14 of lounge 12 in a releasable manner so as to pivotally mount main dome section 18 on frame 14 for swinging movement relative to lounge 12.

Latches 40 are mounted on dome sections 18, 20 and 22 for selectively releasably securing the associated sections 18, 20 and 22 to rail 38 of frame 14 of lounge 12. More specifically, the latches 40 provided on dome section 18 will hold the section 18 against lateral swinging movement relative to frame 12, while the latches 40 provided on the sections 20 and 22 will secure the associated sections 20, 22 against swinging movement toward one another as shown by the broken lines in FIG. 1. In addition, projections 42 are provided on the front and rear end edges of main dome section 18 for guidingly receiving the adjacent edges of sections 20 and 22 when same are in abutting relationship with section 18 as seen in FIG. 1.

Figure 4:
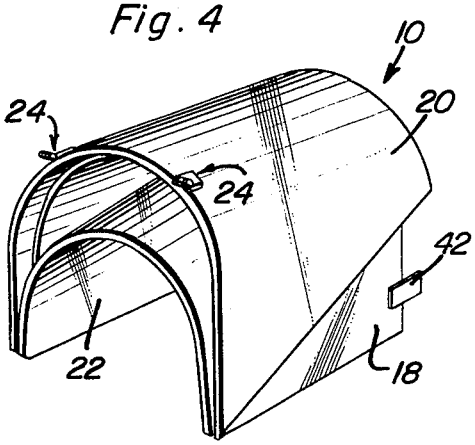
FIG. 4 is a perspective view showing the wind shield dome as set forth in FIGS. 1 through 3 in a collapsed position.

Referring now to FIG. 4 of the drawing, there is shown, somewhat schematically, an arrangement wherein the three sections 18, 20 and 22 of dome 10 can be nested together for purposes of providing a compact unit to be stored when dome 10 is not in use. The pins can be removed from hinges 24 in a simple manner and the various sections stacked up over one another. It will be noted that the head and foot sections 20 and 22, respectively, are illustrated as tapering away from the end edge thereof on which hinges 24 are affixed to the associated sections 20, 22.

As can be readily understood from the above description and from the drawing, a wind shielding dome according to the present invention provides a simple yet versatile and reliable device for protecting a lounger from wind, cold and rain, while permitting the sun's rays to reach the lounger. Each section of the dome can be moved independent of the other by the lounger without the necessity of the lounger getting up from the reclining position in order to make the necessary adjustments. More specifically, a dome according to the present invention is constructed in such a manner that if one lies under it, the person can lift the entire unit or lift either the head or foot dome section only, as desired. Either the head or foot dome sections may be removed from the unit simply by releasing the individual dome from its hinge.

Although each section of a dome according to the invention has been described above as constructed from a self-supporting sheet of suitable polymeric resin bent into the appropriate configuration, it will be understood that each dome section could be constructed in a conventional manner from a frame in suitable covering material.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A wind shielding dome for a multi-position lounge, comprising, in combination:

(a) a main dome section;

(b) a head dome section and a foot dome section each pivotally connected to the main dome section in spaced relation to one another for conforming to a lounge on which the dome is arranged; and (c) fastener means for removably attaching the dome to the lounge, each of the main dome section, head dome section, and foot dome section being a curved element constructed from a transparent material, the curvature being transverse of the extent of the main dome section, head dome section and foot dome section, the fastener means including at least one clip comprising, in combination:

(1) a pair of levers, each having a handle portion and a jaw portion, with an arcuate recess provided in the jaw portion, with one of the levers being affixed to the main dome section adjacent a lateral edge of the section; and (2) a torsion spring connected to the levers and forming a fulcrum for biasing the jaw portion of each of the levers toward the jaw portion of the other of the levers, with the recess of each jaw portion being disposed opposite the recess of the other jaw portion, the recesses arrangeable gripping a rail of the frame of the lounge.

2. A structure as defined in claim 1, further including latch means associated with the main dome section, foot dome section, and head dome section, for releasably securing the main dome section, foot dome section and head dome section to a frame of the lounge.

3. A wind shielding dome for a multi-position lounge, comprising, in combination:

(a) a main dome section;

(b) a head dome section and a foot dome section each pivotally connected to the main dome section in spaced relation to one another for conforming to a lounge on which the dome is arranged;

(c) fastener means for removably attaching the dome to the lounge, each of the main dome section, head dome section, and foot dome section being a curved element constructed from a transparent material, the curvature being transverse of the extent of the main dome section, head dome section and foot dome section; and (d) hinge means for pivotally mounting the head dome section and the foot dome section on the main dome section, the hinge means including hinges mounted on the main dome section adjacent an end edge thereof and substantially midway between lateral edges of the main dome section, the fastener means including at least one clip comprising, in combination:

(1) a pair of levers, each having a handle portion and a jaw portion, with an arcuate recess provided in the jaw portion, with one of the levers being affixed to the main dome section adjacent a lateral edge of the section; and (2) a torsion spring connected to the levers and forming a fulcrum for biasing the jaw portion of each of the levers toward the jaw portion of the other of the levers, with a recess of each jaw portion being disposed opposite the recess of the other jaw portion, the recesses arrangeable gripping a rail of the frame of the lounge.

4. A structure as defined in claim 3, further including latch means associated with the main dome section, foot dome section, and head dome section, for releasably securing the main dome section, foot dome section, and head dome section to the frame of the lounge.

* * * * *